United States Patent [19]

Nelson et al.

[11] Patent Number: 4,589,469

[45] Date of Patent: May 20, 1986

[54] ELECTROLYTIC REFINING OF METAL

[75] Inventors: William Nelson, Birkenhead; John P. Bearpark, Lymm, both of United Kingdom

[73] Assignee: BICC Public Limited Company, London, England

[21] Appl. No.: 628,622

[22] Filed: Jul. 6, 1984

Related U.S. Application Data

[60] Division of Ser. No. 392,762, Jun. 28, 1982, Pat. No. 4,498,522, which is a continuation of Ser. No. 180,000, Aug. 21, 1978, abandoned, which is a continuation of Ser. No. 897,355, Apr. 18, 1978, abandoned.

[51] Int. Cl.[4] ..... B22D 11/06

[52] U.S. Cl. ..... 164/460; 164/481; 164/432

[58] Field of Search ..... 164/701, 477, 481, 263, 164/427, 428, 429, 430, 431, 432, 433, DIG. 1, 460

[56] References Cited

U.S. PATENT DOCUMENTS 1,690,887 11/1928 Davis ..... 164/428
3,860,057 1/1975 Garlick ..... 164/431 X
4,498,522 2/1985 Nelson et al. ..... 164/460

*Primary Examiner*—Nicholas P. Godici
*Attorney, Agent, or Firm*—Buell, Ziesenheim, Beck & Alstadt

[57] ABSTRACT

In a method of continuously casting unrefined electrodes in quantity for use in the electrolytic refining of metal in which a metal e.g. copper, strip is continuously cast and cut at spaced positions along its length to form electrodes, a substantial saving in metal is effected by casting the strip in such a way that, in longitudinally spaced minor portions of its length, the strip has at least one hole, recess in at least one of its side edges, or region of substantially reduced thickness as compared with that of the major portion of its length. When the strip is cut each electrode has, in that portion of the electrode that will protrude above the level of the electrolyte solution when the electrode is supported in an electrolytic cell, at least one hole, re-entrant in an edge of said portion, or region of substantially reduced thickness as compared with that of the main body of the electrode, the area of said hole, re-entrant or region constituting a substantial proportion of said protruding portion of the electrode.

27 Claims, 25 Drawing Figures

ELECTROLYTIC REFINING OF METAL

This application is a divisional of Ser. No. 392,762 filed June 28, 1982, now U.S. Pat. No. 4,498,522; which is a continuation of Ser. No. 180,000 filed Aug. 18, 1978, now abandoned which is a continuation of Ser. No. 897,355 filed Apr. 18, 1978, now abandoned.

In the electrolytic refining of metal by the multiple or series process, plates of the metal to be refined form electrodes, hereinafter referred to as unrefined electrodes, in an electrolytic cell containing an electrolyte solution. Where the metal to be refined is copper, the electrolytic cell usually contains an aqueous solution of copper sulphate acidified with sulphuric acid.

With a view to providing unrefined electrodes that have flatter and smoother surfaces and are more accurate in dimensions than electrodes cast in conventional open moulds and that can be packed closer together than such electrodes, thus reducing the superficial area of the electrolytic cell and/or the consumption of power for a given output of refined metal, it has been proposed to use in the electrolytic refining of copper, unrefined electrodes that have been formed by continuously casting a copper strip of indefinate length and cutting this strip into plates having the required superficial area, preferably of at least 0.74 sq m.

Usually these unrefined electrodes are conveyed from place to place and are suspended in electrolytic cells by means of separately formed hangers which engage in notches formed in the opposite side edges of unrefined electrodes. Separately formed hangers must not only be returned to the electrode-casting apparatus after the electrodes which they were supporting have been used, but they constitute a substantial quantity of the metal which could be more gainfully employed.

With a view to eliminating the use of separately formed hangers, it has been proposed to provide on each side of an electrode, formed by a continuous casting process, an integral shoulder by which the electrode can be suspended whilst it is conveyed from place to place and/or it is supported in an electrolytic cell. In this method, a mould is formed by a moving endless belt providing a supporting surface for molten metal and two laterally spaced moving edge dams which are positioned immediately above the belt and have laterally extending shoulder-forming surfaces on their opposed faces; molten metal is continuously cast in the mould to form a cast strip having longitudinally spaced laterally extending shoulders integral with and formed in each side edge of the strip; and the cast strip is cut at spaced positions along its length to form a plurality of unrefined electrodes, each of which has at least one laterally extending shoulder on each of its side edges. The laterally extending shoulder-forming surfaces are preferably boundary surfaces of recesses in the edge dams and molten metal flows into the recesses to form integral lugs on the strip but, in some circumstances, the laterally extending shoulder-forming surfaces may be boundary surfaces of lateral projections on the edge dams which project into the molten metal in the mould to form inwardly extending recesses in the strip.

Where continuously cast unrefined electrodes with integral lugs are to be employed in the multiple process of electrolytically refining metal, in which process the unrefined electrodes form anodes and are supported by the integral lugs in the electrolyte solution alternately with initially thin cathode plates, customarily of pure metal, a direct current is passed from the anodes through the electrolyte solution to the cathodes and metal is dissolved from the anodes and is carried to and deposited on the cathode plates. One of the lugs on each anode suspended in the electrolytic cell may be supported on an elongate electric contact extending along the top of a side wall of the cell and may constitute the means by which the direct current is introduced into the anode. Since, for obvious reasons, the electric contact must be well clear of the electrolyte solution, even if the lugs on an anode are at one extreme end of the anode, a substantial porportion of the anode protrudes above the surface of the electrolyte solution and plays no active part in the electrolytic refining process. Bearing in mind that a single electrolytic cell in a multiple process can contain as many as forty-five or more anodes, the inactive portions of the anodes protruding above the electrolyte solution can constitute a substantial quantity of metal which, after conclusion of the refining process, must be re-cycled for re-melting and re-casting into unrefined electrodes. Where the metal being refined is copper or other expensive metal, the total quantity of the metal of the anodes of an electrolytic cell that does not play an active part in the electrolytic refining process and that must continuously be re-cycled can amount to a substantial loss of revenue. With a view to reducing the proportion of metal of continuously cast anodes that will protrude above the surface of the electrolyte solution, it has been proposed to cut the continuously cast strip in such a way that a portion of the metal extending between the oppositely-located lugs of an anode will constitute the lowermost portion of the adjacent anode, but shearing apparatus required to effect such a shaped cut across the moving strip would be heavy and expensive and, in fact, at the present time suitable shearing apparatus for carrying out this proposal may not be readily available.

It is an object of the present invention to provide an improved method of continuously casting unrefined electrodes in quantity for use in the electrolytic refining of metal, which electrodes when supported in an electrolytic cell will have a substantially reduced portion of inactive metal protruding above the surface of the electrolyte solution as compared with continuously cast electrodes hitherto proposed when similarly supported in an electrolytic cell.

According to the invention, the method comprises continuously casting a metal strip in such a way that, in longitudinally spaced minor portions of its length, the strip has a hole or holes and/or a recess or recesses in one or each of its side edges and/or has a region or regions of substantially reduced thickness as compared with that of the major portion of its length; and cutting the cast strip at spaced positions along its length to form a plurality of unrefined electrodes, each of which electrodes has, in that portion of the electrode that will protrude above the level of the electrolyte solution when the electrode is supported in an electrolytic cell, at least one hole and/or at least one re-entrant in an edge of said portion and/or at least one region of substantially reduced thickness as compared with that of the main body of the electrode, the area of said hole or holes and/or re-entrant or re-entrants and/or region or regions constituting a substantial proportion of said protruding portion of the electrode.

Preferably, the cast strip is formed by introducing molten metal into a mould formed at least in part by a moving endless belt which provides a supporting surface for molten metal and two laterally spaced moving edge dams which are positioned immediately above the belt, but any other suitable method of forming cast strip may be employed. For instance, in one alternative method of casting strip that may be used, molten metal is fed from a container through a laterally extending elongate nozzle between a pair of vertically spaced moving endless bands which each comprise a plurality of separately formed, laterally extending chilling blocks and which define the major surfaces of the cast strip.

Where a mould is formed by a moving endless belt and laterally spaced moving edge dams, preferably, in order to ensure that both major surfaces of the cast strip are flat and smooth, the mould is closed by a second moving endless belt which is positioned immediately above the edge dams.

Where, as is preferred, the laterally spaced moving edge dams have laterally extending shoulder-forming surfaces on their faces which, when the strip is cast, form pairs of laterally extending shoulders integral with and at longitudinally spaced positions along opposite side edges of the strip, said longitudinally spaced minor portions of the length of strip lie between the longitudinally spaced pairs of shoulders and the strip is cut at spaced positions along its length adjacent or through these minor portions to form a plurality of unrefined electrodes each having at least one pair of laterally extending shoulders on opposite side edges of the electrode.

To ensure that the positions of the laterally extending shoulder-forming surfaces on the opposed faces of the edge dams are maintained substantially constant with respect to one another during advance of the edge dams, preferably advance of the edge dams is synchronised to maintain the two edge dams in correctly phased relationship. Any suitable synchronisation means may be employed for this purpose.

The area of the hole or holes and/or of the re-entrant or re-entrants and/or the area of the region or regions of reduced thickness in each unrefined electrode so formed preferably constitutes a major proportion of that portion of the electrode that will protrude above the electrolyte solution when the electrode is supported in an electrolytic cell. For example, in an unrefined copper electrode having a superficial area of 1.0 sq m, the area of a hole or holes and/or of a re-entrant or re-entrants will lie in the range 75 to 95% of the area of the protruding portion of the electrode and the area of a region or regions of reduced thickness will lie in the range 75 to 100% of the area of the protruding portion of the electrode.

Preferably, a hole or holes and/or a recess or recesses and/or a region or regions of reduced thickness in said longitudinally spaced minor portions of the length of cast strip is or are formed by means of a plurality of substantially rigid elongate members which extend transversely across or partly across the belt and are carried by the laterally spaced moving edge dams at spaced positions along their lengths. A part or parts of each elongate member may be of such a thickness that molten metal flows around said part or parts to form a hole or holes in, or a recess or recesses in a side edge of, the cast strip and/or a part or parts of one of its surfaces may be spaced from the surface of the belt or of one of the belts and extends or extend lengthwide of the belt from one side edge of the elongate member to the other so that molten metal flows over or under said part or parts to form a region or regions of the cast strip of substantially reduced thickness as compared with that of the major portion of the length of the strip. Each elongate member may be integral with the edge dams or it may be detachably secured to one or each edge dam so that it can be removed, if required, or replaced by an elongate member of a similar or different form. Preferably, the elongate members extend transversely from one edge dam to the other thereby, in effect, constituting bridging members because, in addition to serving to define a hole or holes, and/or a recess or recesses, and/or a region or regions of reduced thickness in each minor portion of the length of cast strip, the bridging members also assist in maintaining the positions of the laterally spaced shoulder-forming surfaces on the edge dams substantially constant with respect to one another during advance of the edge dams. In order to enable each bridging member to pass more easily around a roller or rollers, each bridging member may be divided in planes normal to the surface of and extending transversely of the or each belt into a plurality of separately formed elements which are detachably secured together.

In an alternative method of forming a hole or holes, recess or recesses and/or a region or regions of reduced thickness in each minor portion of a length of cast strip, and island or islands upstands or upstand from the mould-bounding surface of the belt, or where two belts are employed of at least one of the belts, at spaced positions along the belt and molten metal flows around the island or islands so that a hole or holes and/or recess or recesses is or are formed in the cast strip and/or flows over or under at least a part of the island or islands to form a region or regions of reduced thickness. Where laterally extending shoulder-forming surfaces are provided on the edge dams, advance of the belt or belts and the edge dams is synchronised to maintain the position of the island or islands substantially constant with respect to the associated laterally extending shoulder-forming surfaces.

Preferably, the laterally extending shoulder-forming surfaces on the edge dams are boundary surfaces of recesses in the edge dams and molten metal flows into the recesses to form integral lugs on the strip. Alternatively, the laterally extending shoulder-forming surfaces may be boundary surfaces of lateral projections on the edge dams which project into the molten metal in the mould to form inwardly extending recesses in the strip. In a further embodiment the laterally extending shoulder-forming surfaces may be boundary surfaces of recesses in, and of lateral projections on, the edge dams and be so positioned that each laterally extending shoulder in the strip is common to a laterally projecting lug and an adjacent inwardly extending recess.

Where the mould is formed by a pair of vertically spaced moving endless bands each comprising a plurality of separately formed, laterally extending chilling blocks, spaced chilling blocks on one or each band may be of such a form that at least a part of one surface forms shaping means which bears against a surface of the other band in such a way that a hole or holes is or are formed in, or a recess or recesses is or are formed in a side edge of, the strip or which is spaced from a surface of the other band by a distance such that a region or regions of the cast strip is or are of reduced thickness as compared with that of the major portion of the strip. Some chilling blocks spaced along the length of one or each band may carry along the edges of said surface, shoulder-forming projections which project into the mould and form inwardly-extending recesses in the side edges of the strip.

The invention also includes apparatus for continuously casting unrefined electrodes in quantity for use in the electrolytic refining of metal by the method as hereinbefore described.

The invention further includes an unrefined electrode cast by the method as hereinbefore described.

The invention will now be further illustrated by the following description, by way of example, with reference to the accompanying drawings, in which.

Figure 3:
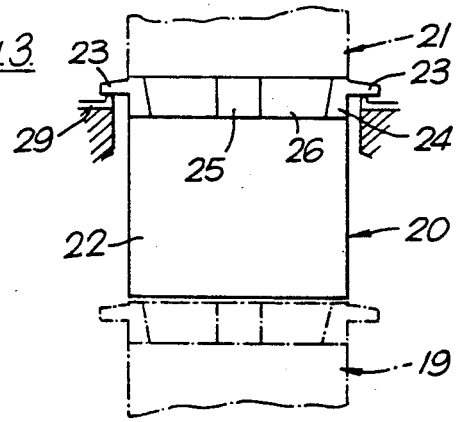
FIG. 3 is a diagrammatic plan view of a preferred unrefined copper electrode.
Figure 5:
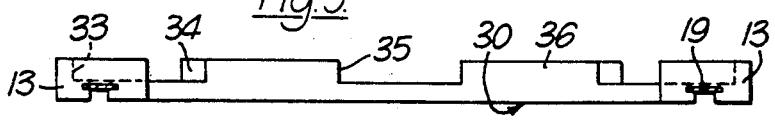
FIG. 5 is an end view of the apparatus shown in FIG. 4 looking in the direction of arrow A.
Figure 7:
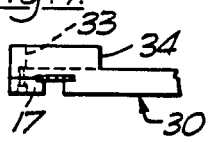
Figure 8:
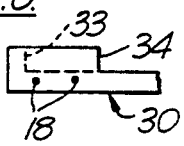
Figure 9:
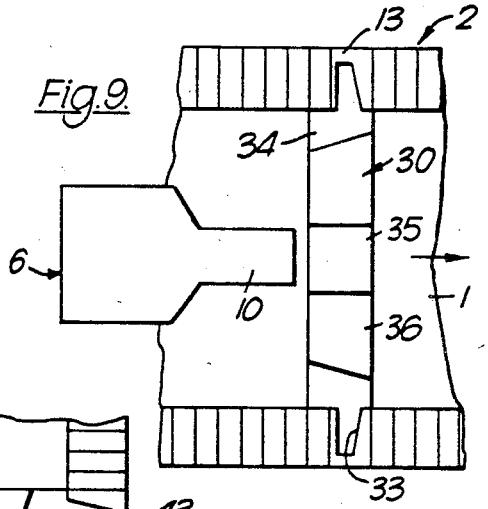
Figure 10:
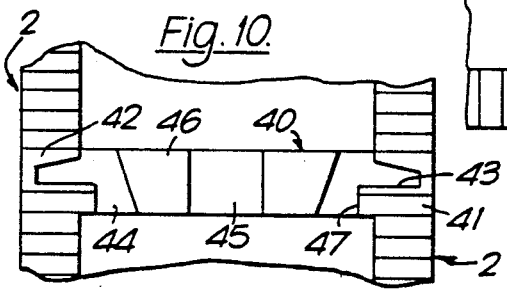
Figure 12:
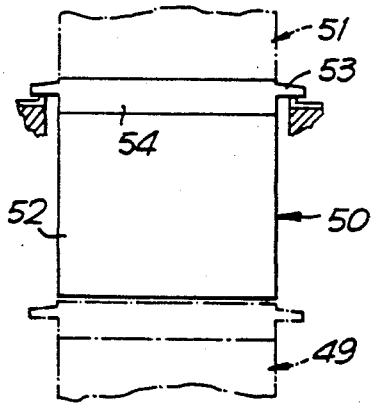
Figure 13:
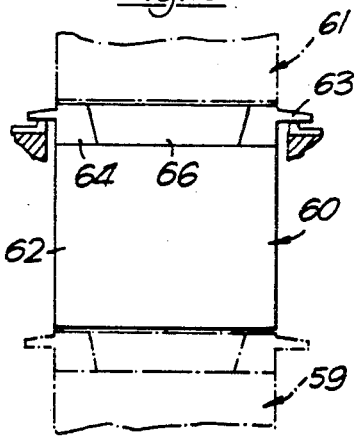
Figure 11:
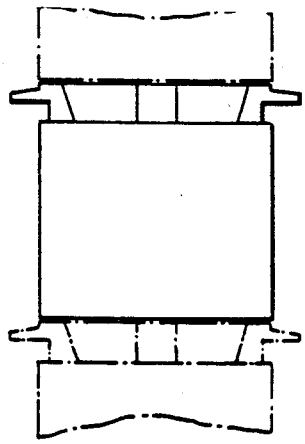
Figure 14:
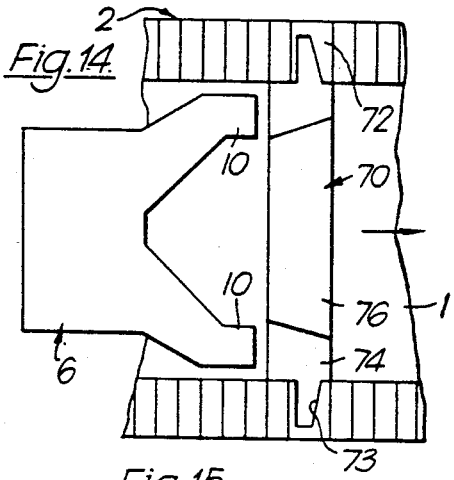
Figure 20:
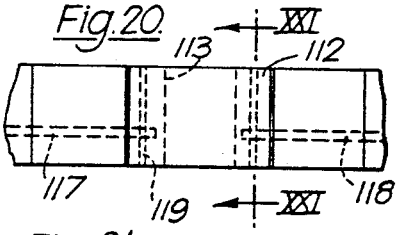
Figure 21:
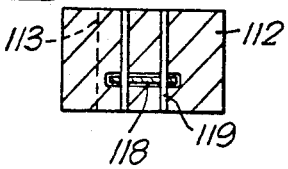
Figure 15:
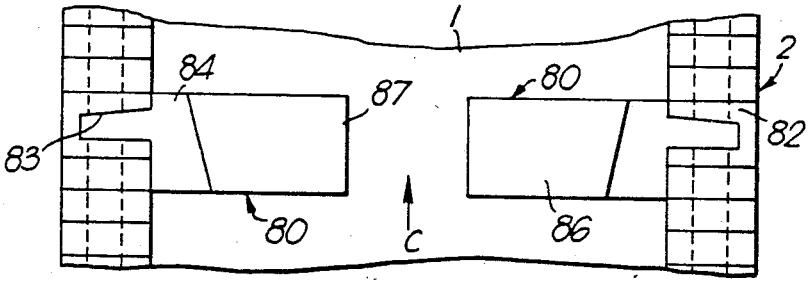
Figure 16:
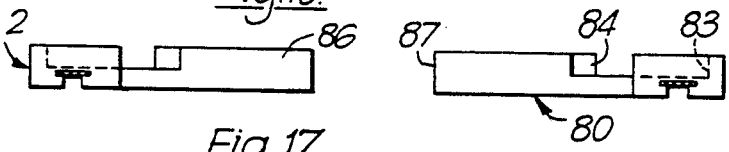
Figure 17:
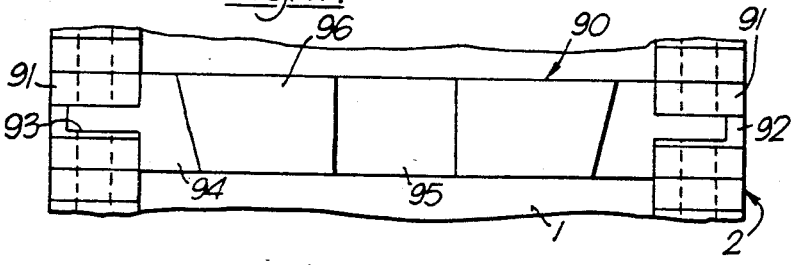
Figure 18:
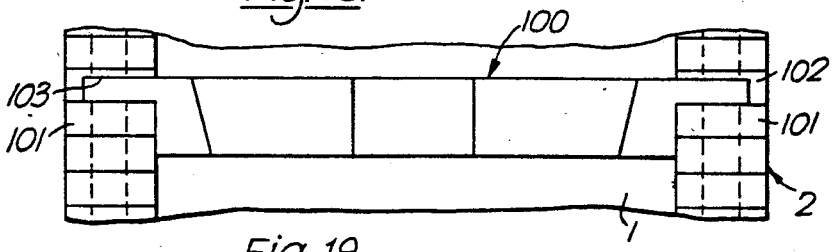
Figure 19:
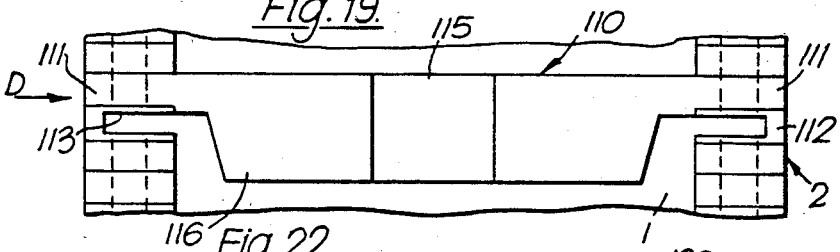
Figure 22:
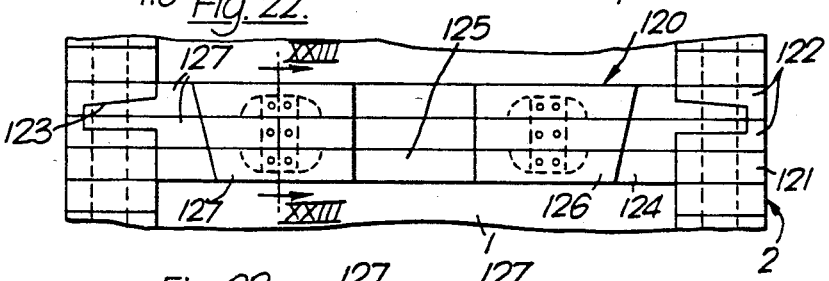
Figure 23:
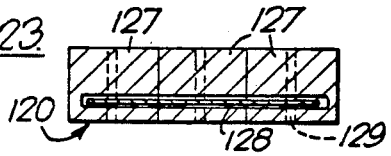
Figure 24:
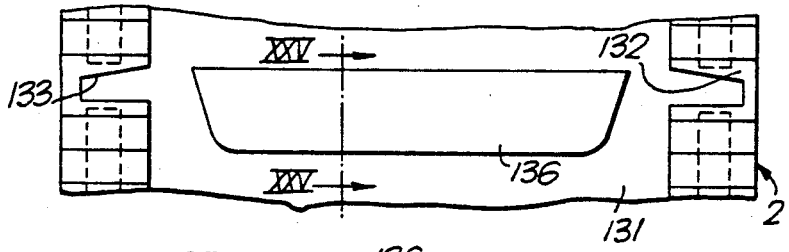
Figure 25:
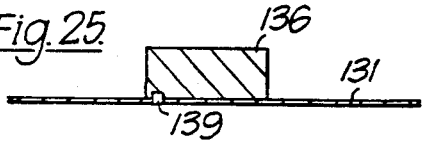

FIGS. 7 and 8, respectively, are fragmental views similar to that shown in FIG. 5 showing modifications of the apparatus;

FIG. 9 is a fragmental diagrammatic plan view illustrating how molten copper is fed into the continuous casting apparatus when casting the electrode shown in FIG. 3;

FIG. 10 is a fragmental diagrammatic plan view of the apparatus employed in casting a second form of unrefined copper electrode;

FIG. 11 is a diagrammatic plan view of the second form of unrefined electrode made using the apparatus shown in FIG. 10;

FIGS. 12 and 13, respectively, are diagrammatic plan views of third and fourth forms of unrefined copper electrodes;

FIG. 14 is a fragmental diagrammatic plan view illustrating how molten copper is fed into the continuous casting apparatus when casting the electrode shown in FIG. 13;

FIG. 15 is a fragmental diagrammatic plan view of the apparatus employed in casting a fifth form of unrefined copper electrode;

FIG. 16 is an end view of the apparatus shown in FIG. 15 looking in the direction of arrow C;

FIGS. 17, 18 and 19, respectively, are diagrammatic plan views of three forms of apparatus employed in casting unrefined copper electrodes;

FIG. 20 is a side view of the apparatus shown in FIG. 19 looking in the direction of arrow D;

FIG. 21 is a sectional view taken on the line XXI—XXI in FIG. 20;

FIG. 22 is a fragmental plan view of alternative apparatus for use in casting the electrode shown in FIG. 3;

FIG. 23 is a sectional view taken on the line XXIII—XXIII in FIG. 22;

FIG. 24 is a fragmental plan view of a further alternative form of apparatus employed in casting unrefined copper electrodes;

FIG. 25 is a sectional view taken on the line XXV—XXV in FIG. 24.

Figure 1:
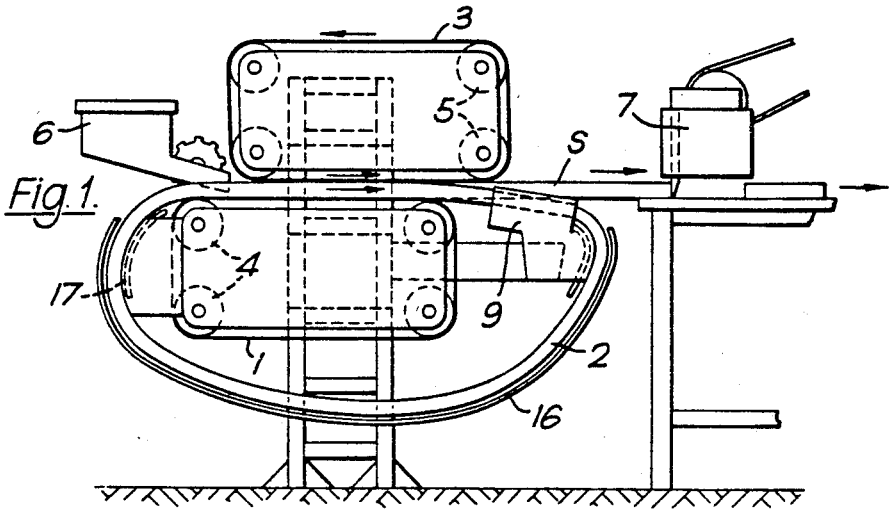
FIG. 1 is a side elevation of the preferred continuous casting apparatus.
Figure 2:
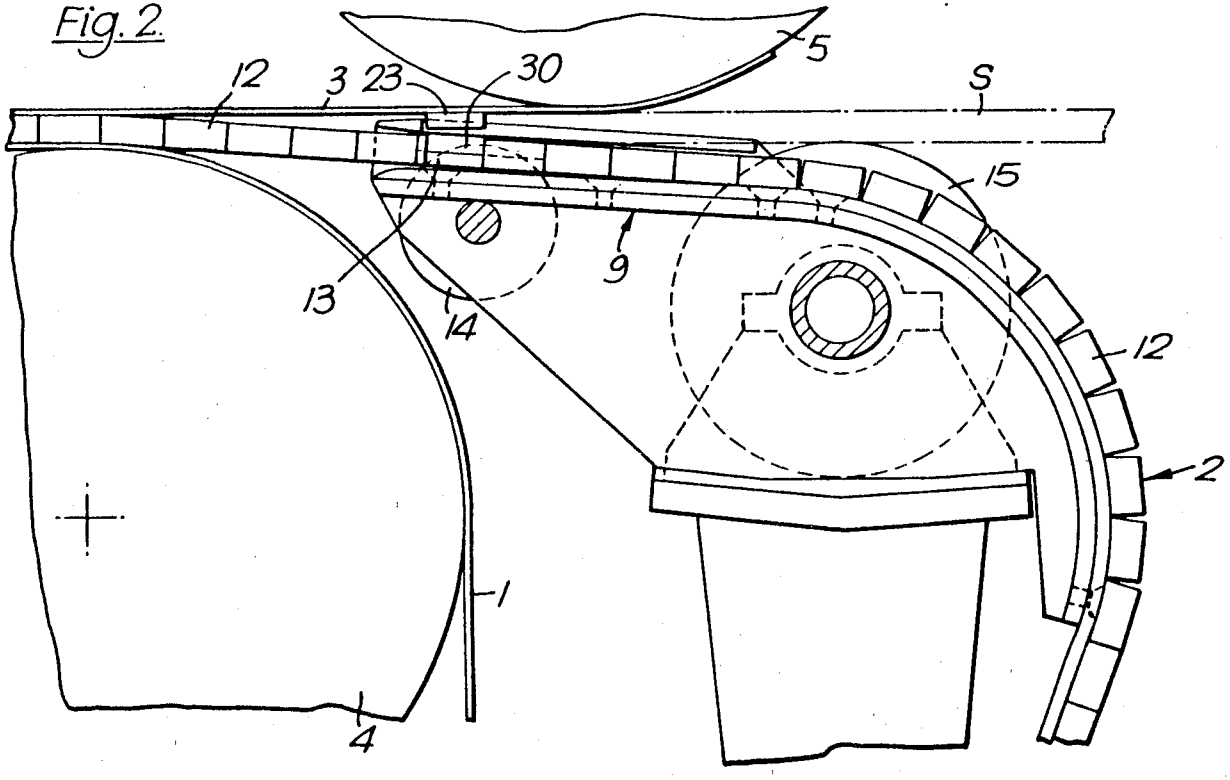
FIG. 2 is a detailed side elevation of the exit end of the apparatus shown in FIG. 1.
Figure 6:
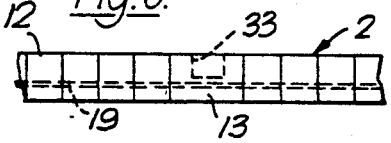
FIG. 6 is a side view of the apparatus shown in FIG. 4 looking in the direction of arrow B.

The continuous casting apparatus shown in FIGS. 1 and 2 comprises a mould formed by a lower moving endless belt 1 constituting a supporting surface for molten copper, two laterally spaced moving edge dams 2 (of which one only can be seen) positioned immediately above the belt 1, and an upper moving endless belt 3 positioned immediately above the edge dams. Belt 1 is supported by a carriage assembly including four rollers 4; belt 3 is supported by a carriage assembly including four rollers 5. Molten copper is fed into the mould from a feeder 6 which may be of conventional form or which, as later described, may be modified for the purposes of the present invention. Cooling is provided for each of the belts 1 and 3 so that the copper solidifies as the belts advance and a solid strip S emerges from between the belts. Shearing apparatus 7 cuts the cast strip S at spaced positions along its length to form a plurality of unrefined electrodes.

Each edge dam 2 is formed from a plurality of metal blocks 12 which are connected together in end-to-end relationship by means of a continuous flexible metal strap (not shown) in a known manner. At the exit end of the mould, guides 9, downwardly inclined at an angle of approximately 5°, direct the edge dams 2 downwardly from the cast strip S and, as will be later explained, assist in disengagement from the edge dams of lugs cast integrally with the strip. The cast strip S emerging from the mould and moving towards the shearing apparatus 7 is supported by rollers 14 and water-cooled rollers 15.

A preferred form of unrefined copper electrode 20 is shown in FIG. 3 and is formed by a continuous casting process in a manner to be described with reference to FIGS. 1 and 2 and FIGS. 4 to 9. Adjacent electrodes 19 and 21 are also formed during the casting process but are sheared off when solidified, these electrodes having been illustrated simply to give an indication of the general method of manufacture. The electrode 20 comprises a plate 22 having at one of its ends and projecting from each of its side edges integral lugs 23 by means of which, when in use, the electrode will be suspended on supports 29. The lugs 23 are integral parts of regions 24 which are of substantially reduced thickness as compared with that of the plate 22. A central region 25 between the lugs 23 is also of reduced thickness and is spaced from the regions 24 by re-entrants 26.

The lugs 23, regions 24 and 25 and re-entrants 26 in each unrefined electrode 19, 20, 21 are formed by one of a plurality of bridging members 30 which extend transversely between and are detachably secured to the edge dams 2 at spaced positions along their length. As will be seen in referring to FIGS. 2 and 4 to 6, each end 13 of the bridging member 30 constitutes a block of an edge dam 2. The bridging member 30 is of substantially the same thickness as the edge dams 2 but near each of its ends 13 it has a recess 34 which runs into a recess 33 of similar depth in the end. The recesses 33 and 34 serve to form the integral lugs 23 and regions 24 during the casting operation. At a central position of the bridging member 30, a recess 35 serves to form the central region 25 of the electrode 20. The parts 36 of the bridging member between the recesses 34 and 35 serve to form holes from which re-entrants 26 will be formed when the strip is cut. During the casting operation, molten copper fills the recesses 33, 34 and 35 and, at the leading end of the mould, the lugs 23 ride out of the edge dam recesses 33 by virtue of the downwardly-inclined guides 9. During the cutting operation, if desired the central region 25 of each electrode may be punched out or otherwise removed.

As previously mentioned, the blocks 12, and the ends 13 of the bridging members 30, are connected together in end-to-end relationship by means of a continuous flexible metal strap 19. To provide for ready replacement of a bridging member 30, the ends 13 of the bridging member can be disengaged from the metal strap 19 by removal of a separately formed part 17 (FIG. 7) which is detachably connected to the member. In an alternative method of connecting together the blocks 12, and the ends 13 of the bridging member 30, shown in FIG. 8, the metal strap 19 is replaced by two steel strands 18.

As will be seen in referring to FIG. 9, to provide for feeding of molten copper into the mould, the nozzle 10 of the feeder 6 is of such a form that molten copper is fed towards the central portion of the mould.

FIG. 10 shows a modified form of bridging member 40 which provides laterally extending shoulder-forming surfaces that are the boundary surfaces of recesses 43 in the ends 42 of the member and of lateral projections 47 on blocks 41 of the edge dams 2. As in the case of the bridging member 30 shown in FIGS. 4 and 5, the recesses 44 are continuations of the recesses 43 in the ends 42 of the bridging member 40 and the bridging member has a central recess 45. The recesses 44 and 45 are separated by parts 46 which are of the same thickness as the edge dams 2 and serve to form holes in the cast strip. FIG. 11 shows a diagrammatic plan view of an electrode formed by using bridging members 40.

In the third form of unrefined electrode 50 shown in FIG. 12 and continuously cast with adjoining electrodes 49 and 51, one end of the plate 52 of the electrode 50 has integrally cast lugs 53 that project from a region 54 of reduced thickness as compared with that of the plate.

Referring to FIGS. 13 and 14, a fourth form of unrefined electrode 60 continuously cast with adjoining electrodes 59 and 61 comprises a plate 62 having at one end integrally cast lugs 63 which project outwardly from regions 64 of reduced thickness as compared with that of the plate. The regions 64 are separated by a central re-entrant 66. Each transversely extending bridging member 70 used in the formation of electrodes 60 is of the same thickness as the edge dams 2 and has near its ends recesses 74 which run into recesses 73 of similar depth in the ends 72 of the member constituting blocks of the edge dams. The recesses 73 and 74 serve to form the integral lugs 63 and regions 64 during the casting operation. The central part 76 of the bridging member 70 serves to form a hole from which the re-entrants 66 will be formed when the strip is cut. To provide for feeding of molten copper into the mould, the feeder 6 has a pair of nozzles 10 for feeding molten copper to the vicinity of the recesses 74 in the bridging member 70.

Instead of employing bridging members which extend across the full width between the edge dams 2, as will be seen on referring to FIGS. 15 and 16, at spaced positions along the length of each edge dam 2, a block 82 of the edge dam has a limb 80 integral with the block which extends part way across the width between the edge dams. Each block 80 has a recess 84 which runs into a lug-forming recess 83 in the block 82. The limbs 80 are separated by a gap 87 through which molten copper will flow during the casting operation. The parts 86 of the limbs 80 will serve to form recesses in the upper edge of the electrode. If desired, the tongue of copper formed in the gap 87 may be punched out or otherwise removed during the cutting operation.

Figure 4:
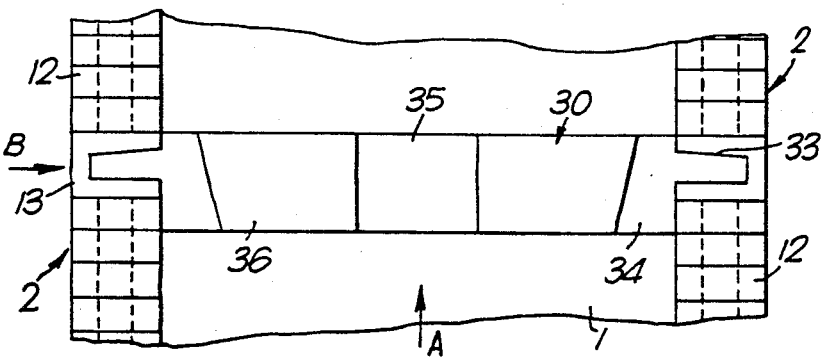
FIG. 4 is a fragmental diagrammatic plan view of of the apparatus employed in casting the electrode shown in FIG. 3.

FIGS. 17 and 18 show alternative forms of the bridging member shown in FIGS. 4 and 5. In each of these alternative forms, the bridging member is separately formed with respect to, and is not connected to, the blocks of the edge dams 2 in which lug-forming recesses are provided. The bridging member 90 shown in FIG. 16 is integral with blocks 91 in the edge dams 2. Adjacent blocks 92 have lug-forming recesses 93 which are of the same depth as recesses 94 and 95 in the bridging member 90. Parts 96 of the bridging member 90 serve to form holes in an electrode whilst the recesses 93, 94 and 95 serve to form regions of reduced thickness. The bridging member 100 shown in FIG. 17 is similar to that shown in FIG. 16 except that the positions of the blocks that are integral with the bridging member and the blocks incorporating the lug-forming recesses are interchanged. Hence, the blocks 101 are integral with the bridging member 100 and the blocks 102 incorporating lug-forming recesses 103 are separately formed with respect to and are not connected to the bridging member.

In the arrangement shown in FIGS. 19 to 21, the bridging member 110 is integral with blocks 111 of the edge dams 2 and has a central recess 115. Blocks 112, adjacent the blocks 111, have lug-forming recesses 113 that extend the full depth of the blocks. Parts 116 of the bridging member serve to form recesses in the upper edge of an electrode. Since the recesses 113 extend the full depth of the blocks 112, the metal strap serving to connect the blocks of the edge dams 2 cannot be continuous and the ends of adjacent lengths of metal strap 117 and 118 are secured in the blocks 112 by pins 119.

FIGS. 22 and 23 shown another alternative form of the bridging member shown in FIGS. 4 and 5 and in this case the bridging member 120 is built up of three separately formed transversely extending elongate elements 127 which are flexibly interconnected by metal straps 128 secured to the elements by pins 129. The multi-element bridging member 120 passes more easily around rollers guiding passage of the edge dams 2. Two of the elongate elements 127 are integral with blocks 122 which are so shaped as to define lug-forming recesses 123; the other elongate element 127 is integral with blocks 121. The multi-element bridging member 120 has recesses 124 which run into the lug-forming recesses 123 and a central recess 125. Parts 126 of the bridging member 120 serve to form re-entrants in an upper edge of an electrode.

In the arrangement shown in FIGS. 24 and 25, each edge dam 2 includes a block 132 having a lug-forming recess 133. Positioned between the blocks 132 and secured to the mould-bounding surface of the lower belt 131 by fastening devices 139 is an upstanding island 136 which is of the same thickness as the edge dams and which serves to form a recess in the upper edge of an electrode. To enable the island 136 to pass more easily around rollers guiding passage of the belt 131, the island may be built up of two or more separately formed transversely extending elongate members which are flexibly interconnected.

In all cases hereinbefore described, the apparatus shown in FIGS. 1 and 2 is provided with guides 16, 17 to support bridging members, limbs or islands in proper relation to the edge dams 2 in the return loop under the mould.

What we claim as our invention is:

1. A method of forming unrefined electrodes in quantity for use in the electrolytic refining of metal, which method comprises continuously casting molten metal into a mould formed at least in part by a moving endless belt which provides a supporting surface for molten metal and two laterally spaced moving edge dams, which are positioned immediately above the belt to form a cast strip, at least one of said edge dams having a portion extending transversely of the molten metal being cast so as to form in each of a plurality of longitudinally spaced minor length zones of the strip, extending transversely of the strip forming at least one area, which area constitutes a major proportion of said minor length transversely extending zone and in which the thickness of metal is substantially less than that of a similar area of the strip between adjacent longitudinally spaced transversely extending zones; and cutting the strip so cast at positions spaced along its length and so related to said at least one area of each transversely extending zone of the strip as to form a plurality of unrefined electrodes, each of which electrodes has, in that portion of the electrode that will protrude above the level of the electrolyte solution when the electrode is supported in an electrolytic cell, said at least one area which constitutes a major proportion of said protruding portion of the electrode and in which the amount of metal is substantially less than that in a similar area of the main body of the electrode.

2. A method as claimed in claim 1, wherein the mould formed by the moving endless belt and laterally spaced moving edge dams is closed by a second moving endless belt which is positioned immediately above the edge dams.

3. A method as claimed in claim 2, wherein said area or at least one of said areas in each of said longitudinally spaced transversely extending zones of the length of the strip includes a hole formed by one of a plurality of substantially rigid elongate members which extend transversely at least partly across the belts and are carried by the laterally spaced moving edge dams at spaced positions along their lengths.

4. A method as claimed in claim 2, wherein said area or at least one of said areas in each of said longitudinally spaced transversely extending zones of the length of the strip is a recess in a side edge of the strip formed by one of a plurality of substantially rigid elongate members which extend transversely at least partly across the belts and are carried by the laterally spaced moving edge dams at spaced positions along their lengths.

5. A method as claimed in claim 3 or 4, wherein at least one part of each elongate member is of such a thickness that molten metal flows around said part or parts to form a hole or holes in, or a recess or recesses in a side edge of, the cast strip.

6. A method as claimed in claim 2, wherein said area or at least one of said areas in each of said longitudinally spaced transversely extending zones of the length of the strip is a region of substantially reduced thickness as compared with the thickness of the strip between adjacent transversely extending zones, which region is formed by one of a plurality of substantially rigid elongate members which extend transversely at least partly across the belts and are carried by the laterally spaced moving edge dams at spaced positions along their lengths.

7. A method as claimed in claim 2, wherein at least one island upstands from the mould-bounding surface of at least one of the belts, at spaced positions along the belt, and molten metal flows over or under at least a part of the island to form a region of reduced thickness.

8. A method as claimed in claim 2, wherein the laterally spaced moving edge dams have laterally extending shoulder-forming surfaces on their faces which form pairs of oppositely disposed laterally extending shoulders integral with and at longitudinally spaced positions along opposite side edges of the strip and wherein said longitudinally spaced transversely extending zones of the length of strip lie between the pairs of oppositely disposed laterally extending shoulders and the strip is cut at spaced positions along its length adjacent or through these transversely extending zones to form a plurality of unrefined electrodes each having at least one pair of oppositely disposed laterally extending shoulders on the side edges of the electrode.

9. A method as claimed in claim 8, wherein the laterally extending shoulder-forming surfaces on the edge dams are boundary surfaces of recesses in the edge dams and molten metal flows into the recesses to form integral lugs on the strip.

10. A method as claimed in claim 8, wherein advance of the edge dams is synchronised to maintain the two edge dams in correctly phased relationship.

11. A method as claimed in claim 1, wherein said area or areas of each unrefined electrode constitutes a major proportion of the protruding portion of the electrode.

12. A method as claimed in claim 11, wherein said area or each of said areas is a re-entrant in an edge of the electrode, said area or areas comstituting 75 to 95% of the area of the protruding portion of the electrode.

13. A method as claimed in claim 11, wherein said area or each of said areas is a region of reduced thickness, said area or areas constituting 75 to 100% of the area of the protruding portion of the electrode.

14. A method as claimed in claim 1, wherein the metal being refined is copper.

15. Apparatus for forming unrefined electrodes in quantity for use in the electrolytic refining of metal, which apparatus comprises a strip-casting mould formed at least in part by a moving endless belt which provides a supporting surface for molten metal and two lateraly spaced moving edge dams which are positioned immediately above the belt; shaping means carried by at least one of the edge dams and the belts at spaced positions along its length and protruding transversely into the mould, which shaping means will form in each of a plurality of longitudinally spaced zones of the strip extending transversely of the strip at least one area, which area constitutes a major proportion of said transversely extending zone and in which the thickness of metal is substantially less than that of a similar area of the strip between adjacent longitudinally spaced transversely extending zones, and means for cutting the cast strip at portions spaced along its length and so related to the said at least one area of each transversely extending zone of the strip as to form a plurality of unrefined electrodes, each of which electrodes will have in that portion of the electrode that will protrude above the level of the electrolyte solution when the electrode is supported in an electrolytic cell, said at least one area which constitutes a major proportion of said protruding of the electrode and in which the amount of metal is substantially less in thickness than that in a similar area of the main body of the electrode.

16. Apparatus as claimed in claim 15, wherein the mould is closed by a second moving endless belt which is positioned immediately above the edge dams.

17. Apparatus as claimed in claim 16, wherein the shaping means comprises a plurality of substantially rigid elongate members which extend transversely at least partly across the belts and are carried by the laterally spaced moving edge dams.

18. Apparatus as claimed in claim 17, wherein each elongate member has at least a part of such a thickness that molten metal will flow around said part to form a hole in, or a recess in a side edge of, a cast strip.

19. Apparatus as claimed in claim 17, wherein each elongate member is detachably secured to at least one of the edge dams.

20. Apparatus as claimed in claim 17, wherein each elongate member is divided in planes normal to the surface of and extending transversely of each belt into a plurality of separately formed elongate elements which are detachably secured together.

21. Apparatus as claimed in claim 16, wherein at least one island upstands from the mould-bounding surface of at least one of the belts, at spaced positions along the belt, and is of such a thickness that molten metal will flow around the island so that a hole will be formed in a cast strip.

22. Apparatus as claimed in claim 16, wherein at least one island upstands from the mould-bounding surface of at least one of the belts, at spaced positions along the belt, and is of such a thickness that molten metal will flow over or under at least a part of the island to form a region of reduced thickness.

23. Apparatus as claimed in claim 16 or 17, wherein the laterally spaced moving edge dams have oppositely. disposed laterally extending shoulder-forming surfaces on their faces which, when a strip is cast, will form pairs of oppositely disposed laterally extending shoulders integral with and at longitudinally spaced positions along the side edges of the strip.

24. Apparatus as claimed in claim 23, wherein the oppositely disposed laterally extending shoulder-forming surfaces on the edge dams are boundary surfaces of recesses in the edge dams and molten metal will flow into the recesses to form integral lugs on the strip.

25. Apparatus as claimed in claim 23, wherein the oppositely disposed laterally extending shoulder-forming surfaces on the edge dams are boundary surfaces of lateral projections on the edge dams which project into the mould and will form inwardly extending recesses in the strip.

26. Apparatus as claimed in claim 23, wherein the oppositely disposed laterally extending shoulder-forming surfaces on the edge dams are boundary surfaces of recesses in, and lateral projections on, the edge dams and are so positioned that each laterally extending shoulder in the strip will be common to a laterally projecting lug and an adjacent inwardly extending recess.

27. Apparatus as claimed in claim 16, wherein means is provided to synchronize advance of the edge dams in such a way as to maintain the two edge dams in correctly phased relationship with one another.

* * * * *